US005752622A

United States Patent [19]

Abell

[11] Patent Number: 5,752,622

[45] Date of Patent: May 19, 1998

[54] FEMININE PROTECTION DISPENSER

[76] Inventor: Lonna Abell, 2000 Sugar Loaf Dr., Harvey, La. 70058

[21] Appl. No.: 684,086

[22] Filed: Jul. 19, 1996

[51] Int. Cl.[6] ..... A47F 1/00

[52] U.S. Cl. ..... 221/97; 221/283; 221/281

[58] Field of Search ..... 221/199, 312 C, 221/281, 283, 303, 307, 63, 45, 34, 97; 206/233, 495; 242/598.5; 312/45

[56] References Cited

U.S. PATENT DOCUMENTS

| | | | |
|---|---|---|---|
| 2,834,513 | 5/1958 | Schupp | 221/151 |
| 3,445,037 | 5/1969 | Rothbaum | 221/151 |
| 3,837,595 | 9/1974 | Boone | 242/598.5 |
| 4,106,617 | 8/1978 | Boone | 206/233 |
| 4,235,333 | 11/1980 | Boone | 206/233 |
| 4,308,974 | 1/1982 | Jones | 221/151 |
| 4,750,640 | 6/1988 | Kobeck et al. | 221/281 |
| 4,834,316 | 5/1989 | DeLorean | 242/594.5 |
| 4,844,368 | 7/1989 | Hu | 242/598.5 |
| 5,027,974 | 7/1991 | Porter et al. | 221/151 |
| 5,248,105 | 9/1993 | Cooker | 242/598.5 |

*Primary Examiner*—William E. Terrell
*Assistant Examiner*—Khoi H. Tran
*Attorney, Agent, or Firm*—Patent & Trademark Services; Thomas Zack; Joseph H. McGlynn

[57] ABSTRACT

A light weight vertically disposed plastic storage and dispenser which can store and dispense both toilet paper and feminine protection articles such as tampons or napkins. Both dispensers are in the same housing which is mounted to a vertically supported base. Flexible support arms rotatably mounted the toilet paper roll above the feminine article dispenser. Upper and lower openings in the feminine article dispenser allow articles to be placed in it in the upper opening and dispensed one at a time by gravity feed from the lower opening.

6 Claims, 1 Drawing Sheet

FEMININE PROTECTION DISPENSER

BACKGROUND OF THE INVENTION

Dispensers for many types of personal use articles have long been known. Many are specifically designed to dispense specific stored articles based upon the article's shape and size. None are known which provide for the dispensing of different personal feminine hygiene articles from the same dispenser as set forth in this specification.

DESCRIPTION OF THE PRIOR ART

Many types of dispenses for stored articles based upon their shape and size are known. For example, U.S. Pat. No. 2,834,513 to Schupp discloses a dispenser for cylindrical objects such as toothpicks, drinking straws, pencils or the like cylindrical objects. With some dispensers, i.e., U.S. Pat. No. 3,445,037 to Rothbaum, a rotary trap is used to dispense one item at a time. Other rotary trap dispensers (U.S. Pat. No. 4,308,974 to Jones) used for feminine personal hygiene articles, like tampons, can hold a single tampon for dispensing as the drum is turned. Still other rotary dispensers (U.S. Pat. No. 5,027,974 to Porter et al.) dispense stored cotton balls. None however, provide for the dispensing of different personal hygiene articles from a combination unit as set for in the description of the present invention.

SUMMARY OF THE INVENTION

A single light weight vertically disposed housing used to store and allow dispersal of at least two different personal feminine hygiene articles. At the housing's upper section there is a toilet paper dispenser and at its lower section a loading area for tampons or napkins to be dispensed. Provision is made to prevent stored tampons from rolling off the unit. After a rear mounted support portion of the housing is installed, the front main dispenser can be snapped into place into it by connectors.

The primary object of the present invention is to provide an improved dual function storage and dispensing unit for personal hygiene protection articles.

It is also an object of this invention to provide a lightweight easily mounted unit which is simple and convenient to operate.

DESCRIPTION OF THE PREFERRED EMBODIMENT

Figure 1:
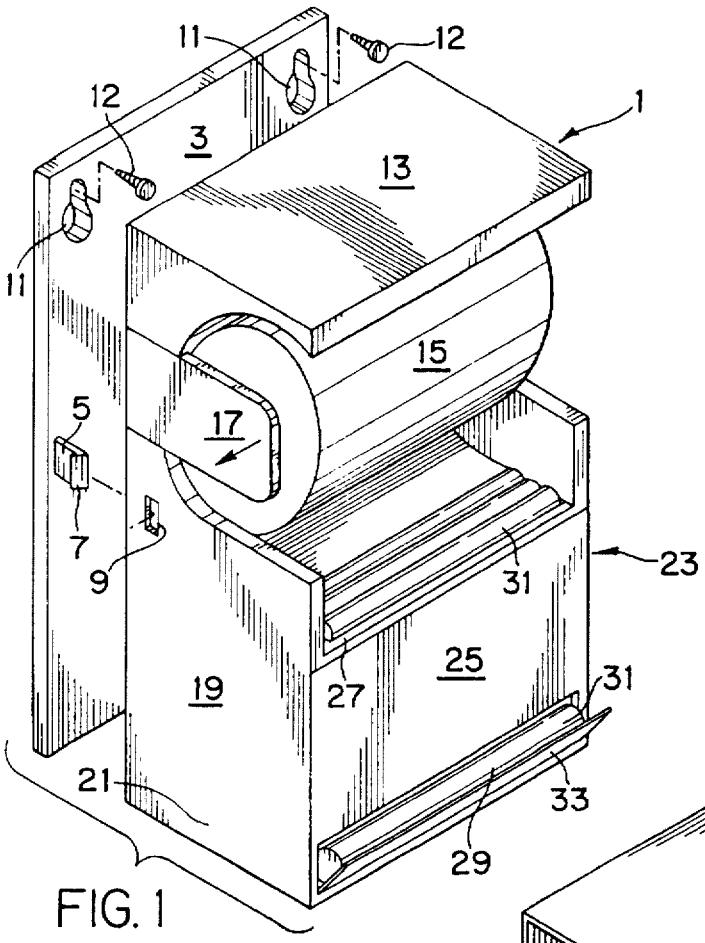
FIG. 1 is a front perspective view of the invention's preferred embodiment before it is mounted to a vertical surface.

FIG. 1 is a front perspective view of the invention's preferred embodiment before it is mounted to a vertical surface. A combined dispenser 1 is vertical disposed and mounted on the rear rectangular base plastic support 3. Two protruding side flexible base tabs 5 (only one shown) fixed to and extending from base 3 having aperture engaging locking enlarged ends 7. Each of these ends are sized and configured to engage the side housing apertures 9 to lock the base 3 to the housing 1. At least two mounting base holes 11 are used with screws 12, wall anchors, nails or the like to vertically support the base against a vertical surface such as a wall or cabinet.

The combined dispenser 1, made of a light weight durable styrene plastic material, has an upper cover 13 which extends over a stored manually dispensable toilet paper roll 15. Forming part of the housing are two flexible identical opposite side arms 17 (only one shown) which hold the paper roll. These flexible arms mount the roll by pulling them apart outwardly in the direction of the arrow. Once mounted in arms 17, pulling on the roll will cause it to rotate in toilet paper hole engaging arm mounted extensions which face inwardly (not shown) and permit manual dispensing of the stored paper. Further down the housing has the main generally closed plastic storage and dispensing section 19. Section 19 sits below the paper roll dispenser and has two side panels 21 and 23, bottom and top panels, and a front panel 25 with two separated openings 27 and 29. Both openings are shaped and sized to receive tampons. The upper larger opening 27 is used to fill section 19 with tampons 31 while the lower smaller opening 29 acts as a gravity dispensing outlet for them one at a time. A tampon outlet lip stop 33 extending across the lower outlet opening prevents the stored tampons from falling while allowing them to be manually removed one at a time.

Figure 2:
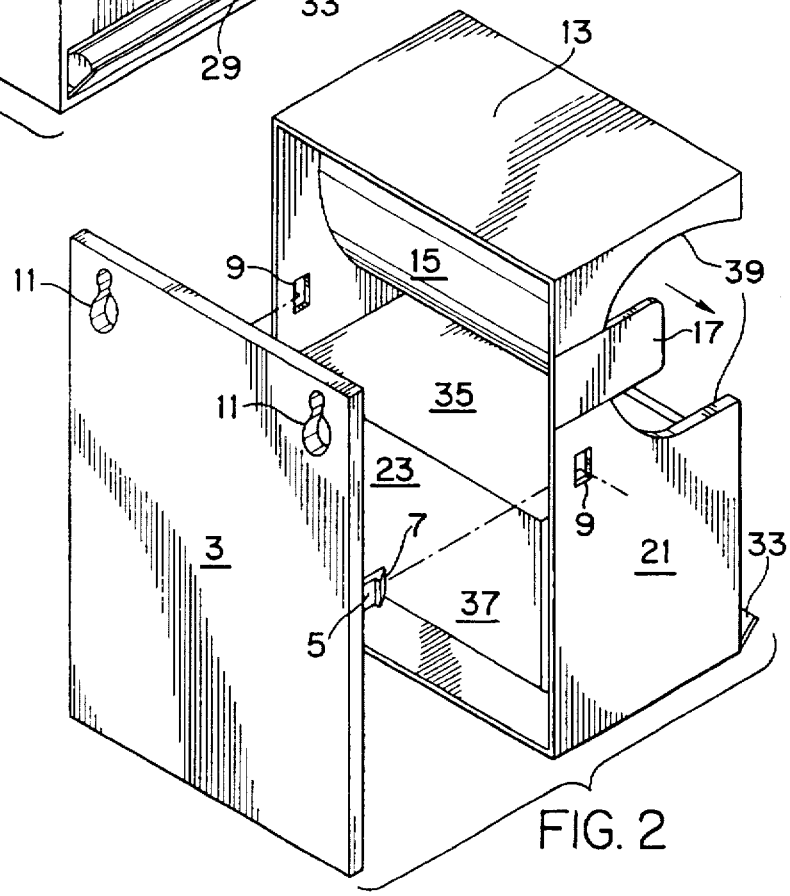
FIG. 2 is a back perspective view of the invention's FIG. 1 preferred embodiment before it is mounted to a vertical surface.

FIG. 2 is a back perspective view of the invention's FIG. 1 preferred embodiment before it is mounted to a vertical surface.

Section 19's top 35 and bottom 37 panels as well as the previously described elements are shown. The housing's curved front opening surface 39 is larger in diameter than a typical paper toilet roll to allow its easy insertion between the two arms 17 and manual dispensing.

Both the base support 3 and the housing 1, including its upper toilet paper holding section and lower tampon storage and dispensing section, would best be manufactured using the plastic injection molding process. Injection molding is a plastic molding process whereby heat softened plastic material is forced under very high pressure into a metal cavity mold, usually aluminum or steel, which is relatively cool. The inside cavity of the mold is comprised of two or more halves, and is the same desired shape as the product to be formed (in this case the feminine protection dispenser ). High pressure hydraulics are used to keep the mold components together during the actual injection phase of the molding process. The injected plastic is allowed to cool and harden in the mold. The hydraulics holding the multiple component mold cavity together are released, the mold halves are separated and the solid formed plastic item is removed. Injection molding can be highly automated process and is capable of producing extremely detailed parts at a very cost effective price. The process should be invaluable in producing this invention's base and housing components cost effectively. After both the base and housing have been injection molded, they can be "snapped" together (via base tabs 5 and housing openings 9) for packaging and shipping purposes.

Variations are contemplated to the described preferred embodiment. For example, the tampons could be dispensed with a rotary trap dispenser rather than a gravity feed as shown, the toilet paper roll could be mounted below the tampon dispenser, the material used to construct the invention could vary.

Although the Feminine Protection Dispenser and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A light weight vertically disposed combined housing used to store and dispense two different personal hygiene articles comprising;

a combined housing used to store and dispense two different personal hygiene articles;

a toilet paper roll storage and dispenser section mounted on said combined housing and forming one of the two different personal hygiene articles that are stored and dispensed;

a gravity fed feminine article storage and dispensing section mounted to said combined housing and forming the other of said two different personal hygiene articles that are stored and dispensed, said feminine article storage and dispensing section having an upper opening shaped and sized to receive the feminine articles to be stored and dispensed and a lower outlet opening from which said feminine stored articles under the influence of gravity can be retrieved by a user; and a base support for said combined housing, said base support having means for receiving and mounting said combined housing with its toilet roll storage and dispenser and gravity fed feminine article storage and dispensing section to a vertically disposed support surface including additional means to mount said base support to said combined housing.

2. The invention as claimed in claim 1 wherein said toilet roll section is located in the combined housing above said feminine article storage and dispensing section.

3. The invention as claimed in claim 2, wherein said feminine article dispenser's is lower opening has an article engaging lip.

4. The invention as claimed in claim 3, wherein:

said base support means to mount said combined housing consists of a plurality of base openings, and said means for mounting said base support to said combined housing consists of at least two flexible base support extensions which engage holes in the housing.

5. The invention as claimed in claim 4, wherein said combined housing has flexible extending arms that engage opposite ends of a roll of toilet paper in said toilet paper roll storage and dispenser section to hold the toilet paper and permit its rotation between the extending arms.

6. The invention of claim 1 wherein said feminine article storage and dispensing section has a plurality of elongated tubular shaped tampons within said section.

* * * * *